United States Patent [19]

Dixon

[11] Patent Number: 4,549,185

[45] Date of Patent: Oct. 22, 1985

[54] SIGNAL DISTRIBUTION SYSTEM

[75] Inventor: Thomas O. Dixon, Seabrook, Md.

[73] Assignee: Amstar Technical Products Co., Inc., New York, N.Y.

[21] Appl. No.: 317,606

[22] Filed: Nov. 3, 1981

[51] Int. Cl.[4] ..... H01Q 3/22; H01Q 3/24

[52] U.S. Cl. ..... 343/368; 455/273; 455/6

[58] Field of Search ..... 343/371, 373, 376, 368; 455/137, 140, 273, 274, 4, 6

[56] References Cited

U.S. PATENT DOCUMENTS

| | | | |
|---|---|---|---|
| 3,151,326 | 9/1964 | Ohm | 455/273 X |
| 3,440,542 | 4/1969 | Gautney | 455/274 |
| 3,986,124 | 10/1976 | Mitchell, Jr. | 455/137 |
| 4,074,266 | 2/1978 | Yokoi et al. | 343/368 |
| 4,176,322 | 11/1979 | Kommrusch | 455/273 X |
| 4,189,733 | 2/1980 | Malm | 343/368 |
| 4,276,653 | 6/1981 | Aarsen et al. | 455/140 X |
| 4,369,520 | 1/1983 | Cerny, Jr. et al. | 455/137 |

FOREIGN PATENT DOCUMENTS

| | | | |
|---|---|---|---|
| 0072548 | 6/1981 | Japan | 455/273 |
| 0007642 | 1/1982 | Japan | 455/273 |
| 0007643 | 1/1982 | Japan | 455/273 |
| 0834979 | 6/1958 | United Kingdom | 455/273 |
| 1123416 | 11/1965 | United Kingdom | 455/273 |

*Primary Examiner*—Theodore M. Blum
*Assistant Examiner*—John B. Sotomayor
*Attorney, Agent, or Firm*—Oblon, Fisher, Spivak, McClelland & Maier

[57] ABSTRACT

A system and method is disclosed for using a combining network to combine antenna beams from different frequency bands so that the same port on the signal distribution system can be used for two or more beams produced by a multidirectional antennae array so that the size of the signal distribution system required is reduced. The combining network uses a series of multiplexing filters which maintain low loss within the antenna frequency bands and a good impedance match at the output port over the frequency range of the combined beams. Only the beams are combined which are either oriented in a different direction or which are not adjacent in frequency so that the problem of signal cancellation at cross-over frequencies between adjacent bands is eliminated.

3 Claims, 3 Drawing Figures

SIGNAL DISTRIBUTION SYSTEM

BACKGROUND OF THE INVENTION

1. Field of the Invention

This invention relates to a signal distribution system for multiband and multidirectional antennae arrays.

2. Description of the Prior Art

One of the primary and most effective antenna used in radio-reception involves a circularly diposed phased array antenna which typically features a series of three array elements as illustrated by the FIG. 1 representative of a AN/FLR-9 antenna manufactured by GTE Sylvania.

The AN/FLR-9 covers a frequency range of 2–30 MHz with the Band A group of antenna elements producing a set of beams in the range of 2–6 MHz, the B band elements producing a set of beams in the 6–18 MHz range and the C band producing the third set of beams having a frequency range of 18–30 MHz. In this way the circular disposition of the antenna array allows for 360° coverage in three separate frequency intervals making up the total from 2–30 MHz. Each band A, B or C is developed by a predetermined number of elements as for example 96 which are taken at 16 element outputs at a time for a particular direction. These 16 outputs go to a beam forming circuit. The next set of outputs develop an output beam from another 16 elements which are oriented in a slightly different manner. This second output series of elements substantially overlap the elements used in developing the first output beam but include at least one additional element not considered in the previous or first output. Thus it can be seen that the total set of beams formed for example in Beam A is developed from a total of 48 elements taken 16 at a time for example. This method allows for a total beam structure to be developed which is respective of signals from an entire 360°. The beam elements for the B band and the C band operate similarly with perhaps differing number of elements. The other structures shown in the FIG. 1 are addressed to the reflecting screens for the band which as shown in the Figure have a single reflecting screen for both bands A and B and a separate reflecting screen for the C band antenna elements.

One of the difficulties with the use of this particular type of phased array system is that the output from the beams in each of the bands A, B, and C must be individually fed to an output distribution system having a port for each of the individual beams in bands A, B and C. The reason for this separate requirement for three ports is related to the difficulties which previous attempts to combine antenna beams have had covering adjacent frequency bands. That is the beams in bands A and B could not be combined to a single distribution port because it had been assumed that beams oriented in nearly the same direction would be combined and would cause difficulty at the cross-over frequencies. These cross-over frequencies, at which the two beams which are combined have approximately the same voltage gain, produced combined signals which could possibly cancel each other out in the combining network. This can be best explained by visualizing the A band covering a frequency between F1 and F2 and the B band covering a frequency between F2 and F3. At a certain point in the gain voltage some of the frequency of the interval between F2 and F3 would be picked up by the A band beams because of overlap and simultaneously some of the frequencies in the F1 to F2 interval would be picked up by the B band beams due to the same overlapping feature. When these two signals are combined in a combining network the possibility exist that the signals which were caught by the overlapping A band would be mixed with the signals caught by the overlapping B band and due to the configuration may possibly be cancelled in the combining network, thus leaving a frequency gap.

Due to these difficulties the prior art required an output distribution port of a signal distribution system for each of the beam A, B, and C arriving from the phase antenna array structure. It is to this specific problem that the present invention addresses its distribution system and method.

SUMMARY OF THE INVENTION

Accordingly, one object of the present invention is to provide a novel signal combining system and method for optimizing the use of ports in a signal distribution system for circularly disposed antenna arrays. The invention derives from a combining network being used to combine antenna beams from different frequency bands produced from the circular antenna array so that the same port on the signal distribution system can be used for two or more beams to thereby reduce the size of the signal distribution required. Only beams are combined which are either oriented in a different direction or beams which are not adjacent in frequency.

The circularly disposed antenna array outputs a plurality of beams each having a different frequency interval with each of the band intervals being adjacent to at least one of the other band intervals. The combination of beams are selected according to a plurality of groups of beams with each group having beams from each of the band beams in such a manner that each of the selected beams is oriented in a different direction from any of the other selected beams which are from a band whose frequency interval is adjacent the selected beam.

A combining network is used to combine the antenna beams from different frequency bands which combining beam network consist of a multiplexing filter which maintains low loss within the antenna frequency bands and a good impedance match at its output port over the frequency range of the combined beams.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
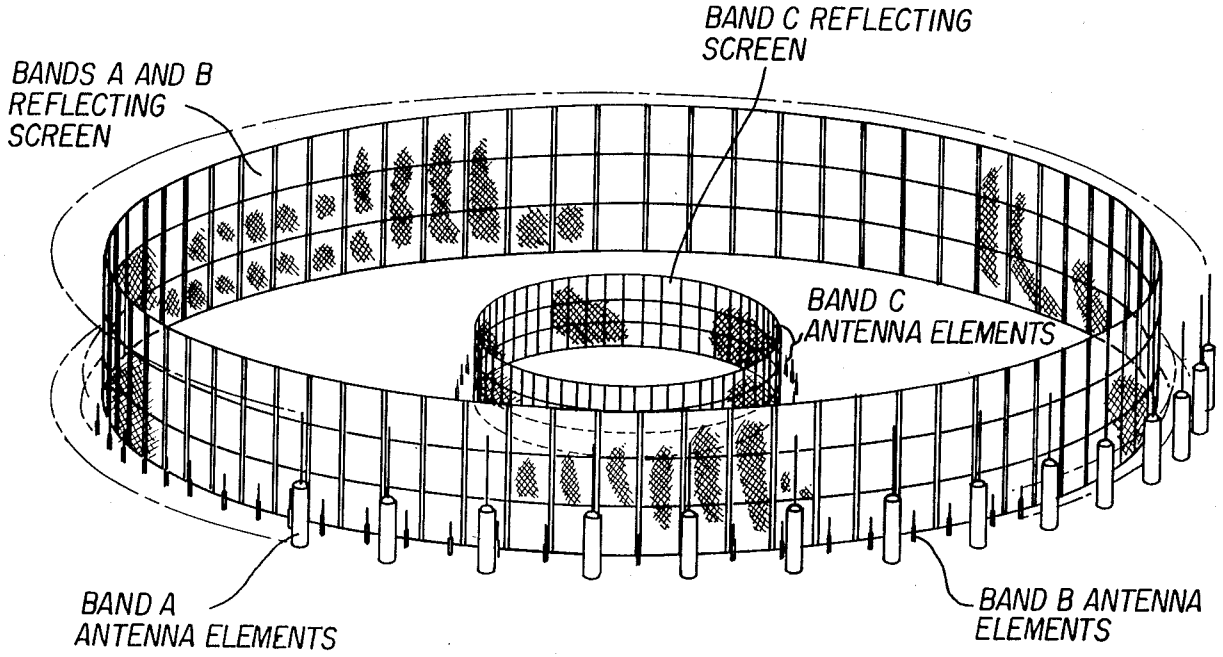
FIG. 1 shows a three-band circularly disposed phased array antenna.
Figure 2:
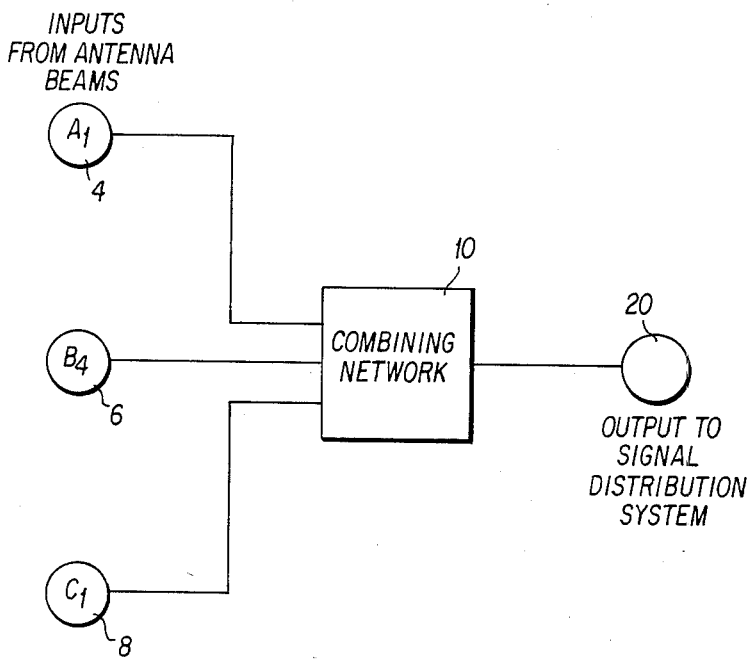
FIG. 2 shows a combining system of the present invention for combining the outputs from the FIG. 1 antenna.

Referring now to the drawings, wherein like reference numerals designate identical or corresponding parts throughout the several views, the implementation of applicant's invention is best shown and disclosed in combination with the combining network of FIG. 2. The FIG. 2 discloses the input antenna beams from each of the bands A, B and C for a directional series of beams $A_1B_4C_1$ to B combined in the network 10 for a feeding to the output port 20 of the signal distribution system. The use of beams $A_1$, $B_4$, $C_1$ will be explained below. As can be seen from the FIG. 2 it is only necessary that one signal distribution port be used with each directional beam of the three bands from the antenna array represented by band A, band B and band C. This represents a reduction in the number of signal distribution system ports to be used which were associated with multiband and multidirectional antenna arrays of the type shown in FIG. 1. The combining network may, for example, consist of a series of multiplexing filters for the bandpass intervals.

Figure 3:
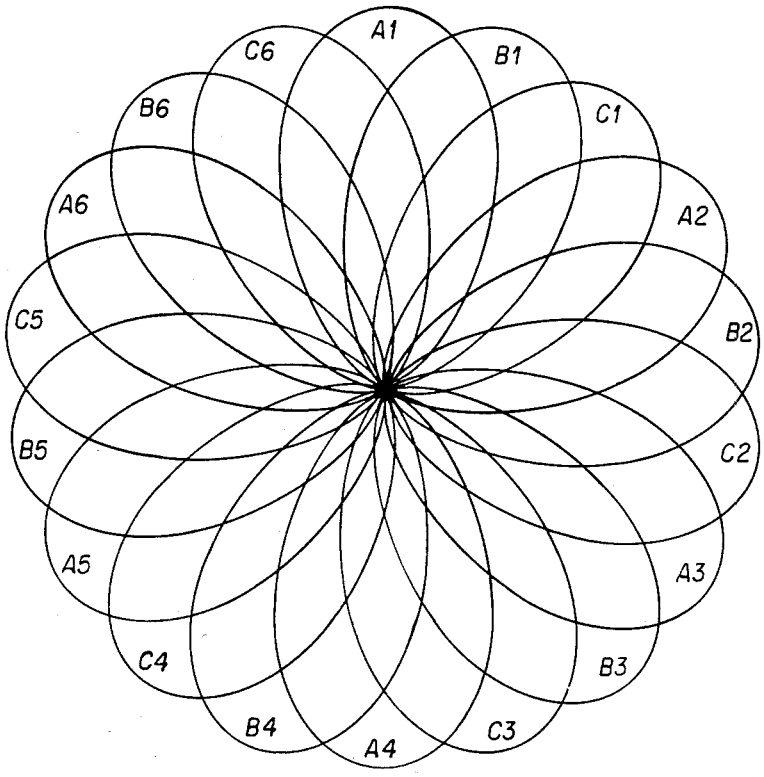
FIG. 3 is a graphical representation of the outputs covering three frequency bands by the circularly disposed antenna array of FIG. 1.

The graph of FIG. 3 illustrates the directional output in each of the three frequency bands from the circularly disposed antenna array of FIG. 1. In the embodiment shown in the FIG. 3 each of the A, B and C bands are shown as having six directional regions which cover a 360° area or a complete circular area.

The generation of the loops A1 through A6 for example in the A band beam construction is best exemplified by a production of a series of A beams accomplished by a directional phase shifting of the elements of the A band array. That is, for example, 16 elements produce a beam A1 which is oriented to point in the direction as shown in FIG. 3. The beam A2 is produced by another set of 16 elements which consist of some of the same elements as constituted the A1 beam. The only requirement is that at least one of the elements of the A1 beam is not included in the A2 beam. Thus the A2 beam is point in a direction which is rotated in a clockwise direction from the A1 beam. The A3 beam likewise contains elements which may be included in the A2 or A1 beam but are shifted in a predetermined number in the same manner that the A2 is shifted from the A1 beam. The number of A beams produced and the number of elements shifted from A1 to A2 is a matter of choice as long as the shift from A beam to A beam is consistent throughout the circumference of the area covered. The same designation and the same type of phase shifting is accomplished in the B bands and the C bands as discussed with conjunction to the A band structure.

The present invention combines only the beams which are oriented in the directions such as beams which are 180° out of phase with each other or beams which are not adjacent in frequency. Thus, with these two restrictions in mind the problem of signal cancellation at cross-over frequencies is eliminated. For example, if a circularly disposed antenna array covers the three adjacent frequency bands A, B and C with beams oriented on adjacent azimuths within each band as is shown in FIG. 3, then beams A1, B4, C1 could be combined without interference as shown in FIG. 2. These three beams follow the two rules discussed above. That is, the beams are either oriented in different directions or beams which are not adjacent in frequency. For example, the beams A1 and B4 are as close to 180° apart as is possible between the A and B band. It is important to separate the A and B bands as they are adjacent frequency bands thereby following the first rule which is to combine only beams which are oriented in different directions. The beam C1 is combined with the B4 and A1 because with respect to B4 and C1 is approximately 180° away in direction. Likewise with regard to A1 the C1 is not adjacent in frequency as the interval F3 to F4 represented by C is not adjacent the interval F1 to F2 so it may be combined. Once these three beams have been combined further combinations merely involve the rotation of each of the beams in order. For example the other five possible combinations include A2, B5, C2; A3, B6, C3; A4, B1, C4; A5, B2, C5; and A6, B3 and C6. These combinations are each fed to a circuitry which is identical to FIG. 2A and FIG. 2B. Each of these combinations of the output reduces the signal distribution system input port requirement from 18 to 6.

Obviously numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A method of combining antenna beams from different frequency bands so that the same port on a signal distribution system can be used for a plurality of beams, comprising the steps of:

receiving radio signals in a circularly disposed antennae array and forming a plurality of bands of beams each band covering a frequency interval adjacent to at least one of the other of said plurality of bands of beams and wherein each band has a plurality of beams with each beam oriented in order to provide a corresponding directionally symmetrically area coverage of an area encompassing a 360° circle about said array;

combining a plurality of groups of beams each said group comprising a selected one of said plurality of beams from each said band selected in such a manner that each one of said selected one of said plurality of beams from each band is oriented so as to be in a substantially different direction from the orientation of any of the other of said selected beams which are from a band whose frequency interval is adjacent the band of said selected one of said plurality of beams.

2. The method of claim 1 wherein said antennae array produces three bands of beams.

3. The method of claim 1 wherein said different direction is a 180° degree direction.

* * * * *

UNITED STATES PATENT AND TRADEMARK OFFICE

CERTIFICATE OF CORRECTION

PATENT NO. : 4,549,185

DATED : October 22, 1985

INVENTOR(S) : Thomas O. Dixon

It is certified that error appears in the above-identified patent and that said Letters Patent is hereby corrected as shown below:

In column 2, line 3, delete "exist" and substitute therefor --exsist--.

In column 3, line 34, delete "point" and substitute therefor --pointed--.

In column 4, line 19, delete "FIG 2A and FIG 2B" and substitute therefor --FIG 2--.

In column 4, line 41, delete "symmetrically" and substitute therefor --symmetrical--.

Signed and Sealed this

*Seventeenth* Day of *June 1986*

[SEAL]

*Attest:*

DONALD J. QUIGG

*Attesting Officer*

*Commissioner of Patents and Trademarks*